United States Patent [19]

Ferris et al.

[11] 4,253,669

[45] Mar. 3, 1981

[54] GAME APPARATUS WITH OBJECT RECEIVING RECEPTACLES AND OBJECT ENGAGING MEMBER

[75] Inventors: Michael J. Ferris, Chicago; Burton C. Meyer, Downers Grove, both of Ill.

[73] Assignee: Marvin Glass & Associates, Chicago, Ill.

[21] Appl. No.: 954,979

[22] Filed: Oct. 26, 1978

[51] Int. Cl.[3] ..... A63F 7/00

[52] U.S. Cl. ..... 273/368; 273/340; 273/357; 273/399

[58] Field of Search ..... 273/95 G, 101, 110, 273/105 R, 138 R, 127 E, 340, 357, 368, 399, 402

[56] References Cited

U.S. PATENT DOCUMENTS

| | | | |
|---|---|---|---|
| 1,670,692 | 5/1928 | Rosar | 273/138 R |
| 2,055,566 | 9/1936 | Warner | 273/127 E |
| 2,280,623 | 4/1942 | Broomfield | 273/138 A |
| 2,668,716 | 2/1954 | Morsch | 273/110 |
| 2,707,634 | 5/1955 | Johnson | 273/138 R |
| 2,794,643 | 6/1957 | Lafleur | 273/138 R |
| 3,108,808 | 10/1963 | Peterson | 273/357 |
| 3,208,751 | 9/1965 | Kostka | 273/105 R |
| 3,617,059 | 11/1971 | Grant | 273/340 |
| 3,711,097 | 1/1973 | Begley | 46/44 X |
| 3,834,701 | 9/1974 | Hashimoto | 273/85 C |

FOREIGN PATENT DOCUMENTS

| | | | |
|---|---|---|---|
| 37513 | 2/1886 | Fed. Rep. of Germany | 273/138 R |
| 737866 | 10/1932 | France | 273/138 R |

*Primary Examiner*—Anton O. Oechsle

*Attorney, Agent, or Firm*—Mason, Kolehmainen, Rathburn & Wyss

[57] ABSTRACT

A game apparatus includes a stationary base with a playing surface and housing rotatably mounted thereon in driving engagement with a spring motor. The playing surface includes a hemispherical central portion and a centrally mounted chute for dropping playing objects onto the playing surface. A circular flange is secured to the outer peripheral edge of the central portion and includes a plurality of receptacles, a first preselected number of which are of a configuration to retain the playing objects received from the central portion. A second preselected number of the receptacles are of a configuration to allow the playing object to pass therethrough. Pivotally mounted on the base are one or more player operated levers for engaging a playing object captured within one of the first type of receptacles for attempted dislodgement and movement to one of the second type for a score.

15 Claims, 3 Drawing Figures

10
24
33
40
44
16
12
18
38
30
42
14
46
20
32
48

56
51
54
48
50
52
20
58
26
30
28
42
18
44
40
46

33
35
34
38
36
24
18
30
28
46
56
53
32
44
40
26
60
58
50
48
20

GAME APPARATUS WITH OBJECT RECEIVING RECEPTACLES AND OBJECT ENGAGING MEMBER

BACKGROUND OF THE INVENTION

A. Field of the Invention

The device of the present invention is a new and improved game apparatus and in particular to a game having a rotatable platform onto which playing pieces are deposited.

B. Description of the Prior Art

Games that are presently popular are those that involve competition between two or more players and require a certain skill for playing the game such as eye-hand coordination. Many games of this type are fast moving and require eye-hand coordination and therefore help develop the player's coordination and serve both as a source of amusement and to assist in the development of the player's skill.

It is desirable that a game of this type be simple in operation requiring a minimum of moving parts but be sufficiently difficult to play so as to require or develop a degree of skill such that the game does not become boring to the player and yet present a challenge to the player or players.

SUMMARY OF THE INVENTION

An object of the present invention is to provide a new and improved game apparatus that requires eye and hand coordination and is relatively inexpensive to manufacture but is challenging to the players of the game.

A game apparatus mode in accordance with the present invention includes includes a housing and a playing surface rotatably mounted on a stationary base portion. The playing surface includes a first central portion of a hemispherical configuration and a circular flange portion secured to the outer peripheral edge thereof. A motor such as a spring type drive is mounted on the base for rotating the playing surface at a desired rate of speed.

The object of the game apparatus is to drop a round ball or playing object onto the central hemispherical portion such that it randomly falls along the hemispherical surface and into one of many receptacles defined in the outer peripheral playing flange. The receptacles are grouped into a preselected number of one type that are of a configuration to capture the ball and allow a portion of the ball to extend beneath the peripheral flange and a predetermined number of a second type of receptacles of a configuration which will allow the ball to pass therethrough.

The game apparatus further includes one or more player operated levers, pivotally mounted on the base, each including a first end that is to be engaged by the hand or finger of a player of the game to pivot the lever and a second end, which rises to a position slightly beneath the circular flange to engage the exposed portion of the ball retained in one of the first group of receptacles. If a player pivots the lever at the precise moment a ball and receptacle are passing, the second end of the lever will engage the ball forcing it out of the receptacle and into an adjacent or other receptacle. If this adjacent or other receptacle is of the configuration of the second type of receptacle, the ball will pass through and out of the housing thus indicating a score for that particular player.

BRIEF DESCRIPTION OF THE DRAWINGS

The above and other objects and advantages and novel features of the present invention will become apparent from the following detailed description of the preferred embodiment of the invention illustrated in the accompanying drawings wherein.

DETAILED DESCRIPTION OF THE PREFERRED EMBODIMENT

Figure 1:
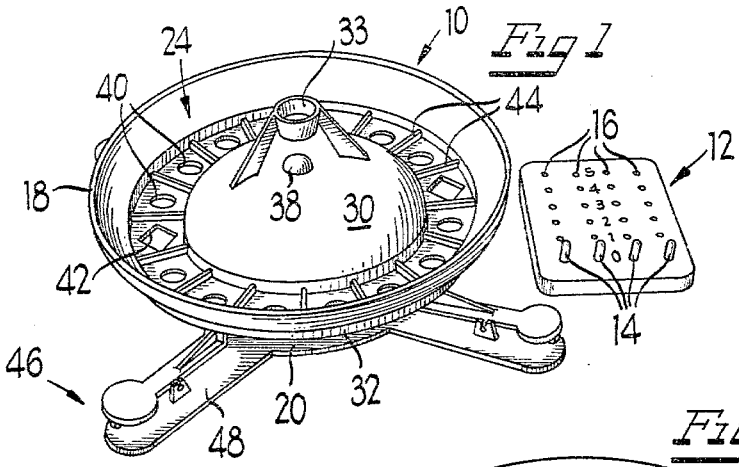
FIG. 1 is a perspective view of the game apparatus and a scoring board constructed in accordance with the principles of the present invention.

With reference to the drawing and initially to FIG. 1 there is illustrated a game apparatus 10 constructed in accordance with the principles of the present invention. The game apparatus 10 includes a central rotatable element and requires the players to exercise hand and eye coordination in order to score points. The scoring of points may be tallied by a board such as the score board 12 illustrated in FIG. 1 wherein individual pegs 14 may be inserted in holes 16 that correspond to the points scored by the individual player.

The game apparatus 10 includes a circular dish-shaped, concave housing 18 that may be mounted on a platform or base 20 for supporting the game on a table or other flat surface. Defined within the housing 18 is a playing surface generally designated by the reference numeral 24. The playing surface 24 is supported above the base 20 and is rotated in one direction by a spring motor 26 such as one of the many commercially available types. In the present embodiment, the motor is cocked or wound by rotating the playing surface 24 in an opposite direction. The motor 26 includes a spindle or shaft 28 extending vertically from the base and motor 26 which is secured to a central portion 30 of the playing surface 24.

The central portion 30 of the playing surface 24 is hemispherical in configuration sloping downwardly to an outer peripheral, generally circular flange 32 and integrally formed with the dish-shaped housing 18. Consequently, the housing 18, the central portion 30 and the flange 32 of the playing surface 24 are mounted and rotated as a unit by the motor 26 through the connection to the spindle 28.

A chute or dropping device 34 is mounted above the central portion 30 of the playing surface 24 and is employed for drop playing objects, such as a ball 36, onto the central portion 30 of the playing surface 24 at the beginning of play. The chute 34 includes a circular ring portion 33 mounted by a pair of struts 35 which also serve to facilitate winding of the motor 26. A circular enlargment or cap 38 is provided to strengthen the structure and will be engaged by the ball 36 when it is dropped through the ring 33.

Figure 3:
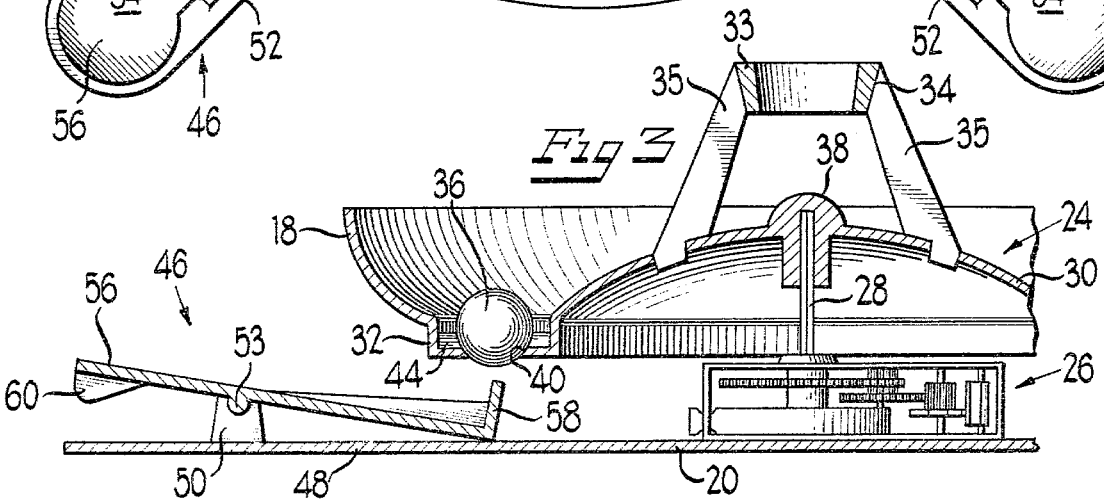
FIG. 3 is a partial, vertical cross-sectional view of the game apparatus of the present invention.

The flange 32 includes a plurality of receptacles of two different configurations or types. A first group of receptacles 40 are circular in configuration and of a size such that the ball 36 once landing in one of these receptacles 40 is captured and prevented from passing therethrough. To assure that the ball 36 is captured in one of the receptacles 40, they are separated from one another by a plurality of flanges or ribs 44. As best illustrated in FIG. 3, the receptacles 40 are of a sufficient size relative to the size of the ball 36 such that a portion of the ball extends below the bottom surface of the flange 32.

The flange 32 also includes a subsequent or second type of receptacles 42 that are of a sufficient size to allow the ball 36 to pass therethrough and out of the housing 18, thus indicating a score for a particular player as described below. The plurality of flanges or dividers 44 between the various receptacles 40 and 42 that extend upwardly from the bottom of the flange 32 and also to prevent the ball 36 from rolling along the flange 32 between receptacles 40 and 42.

Figure 2:
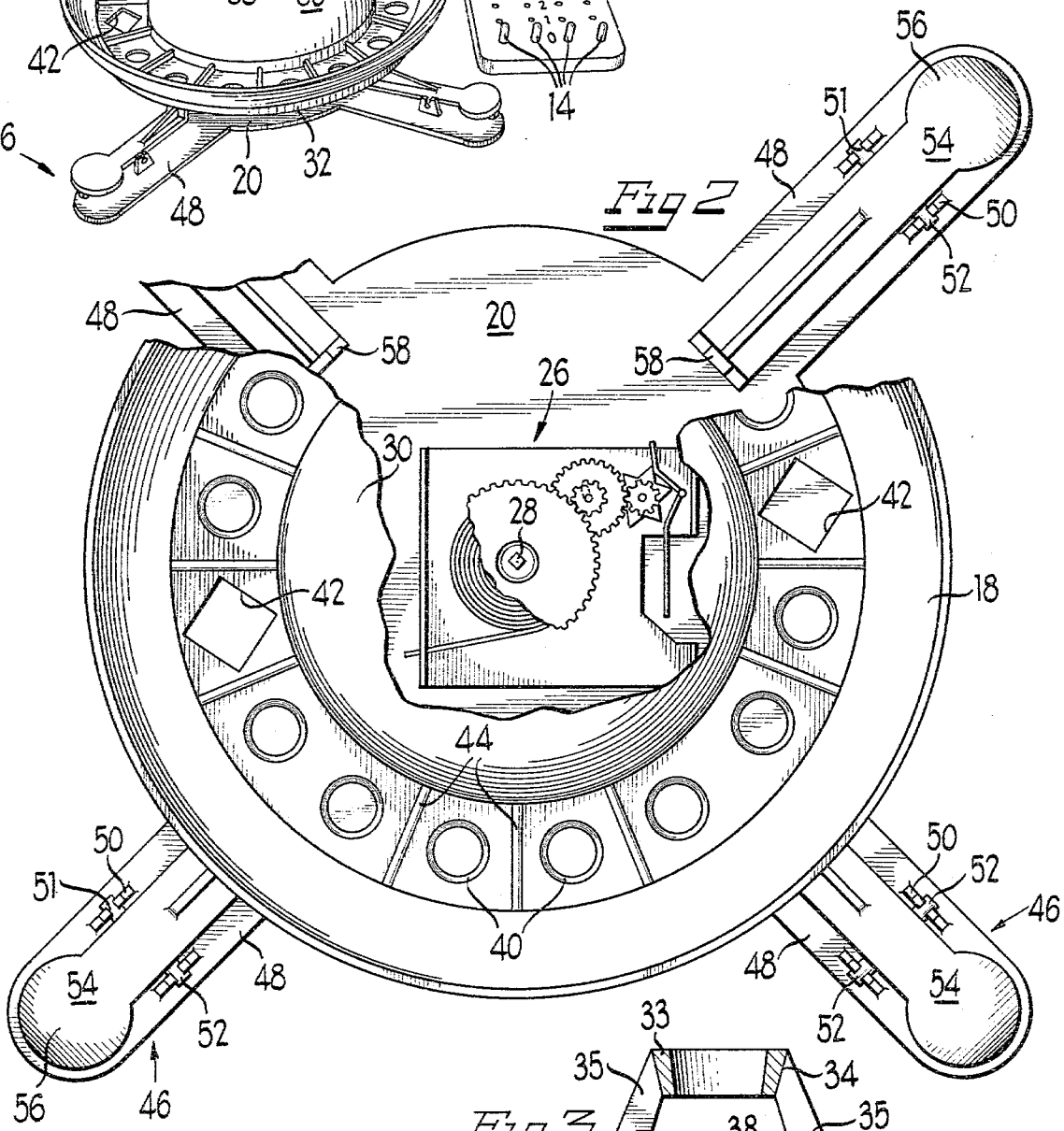
FIG. 2 is an enlarged, partially fragmented top plan view of the game apparatus of FIG. 1.

In one scheme of play, balls 36 are randomly deposited in the chute 34 and the object of the game apparatus 10 is for the players to attempt to move a ball 36 from any one of the receptacles 40 to a receptacle 42 to score a point of carrying the ball to be released. In order to move the ball 36 from the receptacles 40 to the receptacles 42, there are one or more player actuated levers generally designated by the reference numeral 46 mounted on the base as best seen in FIGS. 2 and 3. Each player actuated lever 46 is mounted on a platform 48 extending outwardly from the base 20 in a radial direction. Each platform 48 includes a pair of vertically extending supports 50 which are provided with generally C-shaped apertures 51 at the top thereof. A pair of pins 52 defined on pivot shafts 53 of the individual levers 54 so that the pins 52 snap into the apertures 51 to support the lever 54. This mounting of the levers 54 on the supports 50 allows the levers 54 to be pivoted by a player.

Each lever 54 includes a first player end 56 adapted to be engaged by the player to pivot the lever 54 about the pins 52 to move a second ball contact end 58 of the lever upwardly to engage the portion of a ball 36 extending below the flange 32. Stop means are provided to prevent contact between the end 58 and the lower portion of the flange 32. The limited upward movement of the end 58 is accomplished by a stop member 60 defined on the lower side of the end 56 such that it will engage the platform 48 after the lever 54 pivots a predetermined amount.

If a player actuates the lever 54 when one of the balls 36 in a receptacle 40 is directly over the end 58, it will be struck causing the ball to move upwardly and out of the receptacle 40 and randomly into an adjacent or other receptacle. If the adjacent receptacle is one of the second group of receptacles 42, the ball will fall out and the player will be awarded a score. Play continues until one player attains the score selected as the winning score for the game or according to many other scenes of play.

While only a single embodiment of the present invention has been shown, it will be understood that various changes and modifications may appear to those skilled in the art and it is contemplated by the appended claims to cover all such changes and mofidications as fall within the true spirit of the scope of the present invention.

What is claimed as new and desired to be secured by Letters Patent of the United States is:

1. A game apparatus, comprising:
means defining a playing surface;
at least one playing object;
a first set of receptacles on the playing surface for randomly receiving said playing object;
at least one opening in the playing surface for allowing said object to escape from the playing surface; and
selectively operable means for engaging an object in one of said first set of receptacles to attempt to dislodge the object therefrom for movement generally along the playing surface and to said at least one opening, said selectively operable means comprises at least one lever mounted for movement below said playing surface, a base for supporting the playing surface, and drive means for moving the playing surface relative to the base.

2. The game apparatus set forth in claim 1 wherein said playing surface includes means on a central portion thereof for dropping said playing object and randomly placing said playing object in one of said first set of receptacles or said at least one opening.

3. The game apparatus set forth in claim 1 wherein said playing surface further includes a flange defined on the outer periphery of said playing surface, said receptacles being defined in said flange.

4. The game apparatus of claim 1 wherein said lever is pivotally mounted on the base having a portion extending outwardly from the playing surface for contact by the user and an inner end defining an object engaging element for contacting a playing object in one of said receptacles upon timely actuation thereof by a player of the game.

5. The game apparatus of claim 4 wherein said first set of receptacles are generally circular in shape and of a smaller size than said playing objects to permit a portion of the playing objects to extend below the bottom surface of the playing surface for contact by said selectively operable means.

6. The game apparatus of claim 5 wherein said escape opening comprises at least one aperture in the peripheral flange of the playing surface of a size larger than the playing object to permit the playing object to pass therethrough and thereby escape from the playing surface.

7. A game apparatus, comprising:
a base for supporting the apparatus on a suitable support surface;
a generally concave playing surface, rotatably mounted on the base;
said playing surface including a raised central portion;
a plurality of playing objects;
first and second groups of apertures defined in said playing surface surrounding said central portion;
said first group of apertures are of a size larger than said playing objects to allow said objects to pass therethrough;
said second group of apertures are of a size smaller than said objects allowing said objects to be held therein and extend partially therethrough; and
object engaging means defined on said base beneath said playing surface for use of the players of the game to engage the objects and cause movement thereof over the playing surface.

8. The game apparatus set forth in claim 7 wherein said object engaging means comprises a lever pivotally secured to said base.

9. The game apparatus set forth in claim 8 wherein said lever includes an end adapted to engage said objects while positioned in one of said second group of apetures for actuation of a player of the game to attempt to dislodge an object from one of said second apertures for movement to one of said first apertures.

10. A game apparatus, comprising:
means defining a playing surface;

at least one playing object;

a first set of receptacles on the playing surface for randomly receiving said playing object;

at least one area on the playing surface for allowing said object to escape from the playing surface;

selectively operable means for engaging an object in one of said first set of receptacles to attempt to dislodge the object therefrom for movement over the playing surface;

said selectively operable means comprises at least one lever mounted for movement below said playing surface;

a base for supporting the playing surface, and drive means for moving the playing surface relative to the base;

said lever is pivotally mounted on the base having a portion extending outwardly from the playing surface for contact by the user and an inner end defining an object engaging element for contacting a playing object in one of said receptacles upon timely actuation thereof by a player of the game;

said first set of receptacles are generally circular in shape and of a smaller size than said playing objects to permit a portion of the playing objects to extend below the bottom surface of the playing surface of contact by said selectively operable means; and said escape area comprises at least one aperture in the peripheral flange of the playing surface of a size larger than the playing object to permit the playing object to pass therethrough and thereby escape from the playing surface.

11. The game apparatus set forth in claim 10 wherein said playing surface includes playing piece release means on a central portion thereof.

12. The game apparatus set forth in claim 10 wherein said playing surface further includes a flange defined on the outer periphery of said playing surface, said receptacle being defined in said flange.

13. A game apparatus, comprising:

a base for supporting the apparatus on a suitable support surface;

a generally concave playing surface, rotatably mounted on the base;

said playing surface including a raised central portion;

a plurality of playing objects;

first and second groups of apertures defined in said playing surface surrounding said central portion;

object engaging means defined on said base beneath said playing surface for use of the players of the game to engage the objects and cause movement thereof over the playing surface;

said object engaging means comprises a lever pivotally secured to said base; and said lever includes an end adapted to engage said objects while positioned in one of said second group of apertures for actuation of a player of the game to attempt to dislodge an object from one of said second apertures for movement to one of said first apertures.

14. The game apparatus set forth in claim 13 wherein said first group of apertures are of a size larger than said playing objects to allow said objects to pass therethrough.

15. The game apparatus set forth in claim 13 wherein said second group of apertures are of a size smaller than said objects allowing said objects to be held therein and extend partially therethrough.

* * * * *